US008955184B2

(12) United States Patent
Deschamps

(10) Patent No.: US 8,955,184 B2
(45) Date of Patent: Feb. 17, 2015

(54) TEMPORARY BRIDGE

(75) Inventor: Georges-Paul Deschamps, Voeuil et Giget (FR)

(73) Assignee: ETS A. Deschamps et Eils, La Couronne (FR)

( * ) Notice: Subject to any disclaimer, the term of this patent is extended or adjusted under 35 U.S.C. 154(b) by 579 days.

(21) Appl. No.: 12/302,528

(22) PCT Filed: May 31, 2007

(86) PCT No.: PCT/EP2007/055349
§ 371 (c)(1),
(2), (4) Date: Oct. 5, 2009

(87) PCT Pub. No.: WO2007/138100
PCT Pub. Date: Dec. 6, 2007

(65) Prior Publication Data

US 2010/0031454 A1 Feb. 11, 2010

(30) Foreign Application Priority Data

May 31, 2006 (FR) ..... 06 51976

(51) Int. Cl.
*E01D 15/12* (2006.01)
*E01D 15/133* (2006.01)

(52) U.S. Cl.
CPC ..... *E01D 15/124* (2013.01); *E01D 15/133* (2013.01)
USPC ..... 14/2.4

(58) Field of Classification Search
USPC ..... 14/2, 2.6, 14, 26, 45, 71.1, 2.4; 414/537, 921
See application file for complete search history.

(56) References Cited

U.S. PATENT DOCUMENTS

| | | | | | |
|---|---|---|---|---|---|
| 1,386,450 | A | * | 8/1921 | Tully | 428/17 |
| 2,687,225 | A | * | 8/1954 | Martin | 414/481 |
| 2,961,010 | A | * | 11/1960 | Berry | 139/403 |
| 3,208,086 | A | * | 9/1965 | Gillois et al. | 14/2.6 |
| 3,239,862 | A | * | 3/1966 | Hire | 14/2.4 |
| 3,661,114 | A | | 5/1972 | Wagner et al. | |
| 4,033,006 | A | | 7/1977 | Soffge et al. | |
| 4,164,297 | A | * | 8/1979 | Dorwin | 414/481 |

(Continued)

FOREIGN PATENT DOCUMENTS

| | | | |
|---|---|---|---|
| DE | 545890 | C | 3/1932 |
| DE | 19828499 | A1 | 12/1999 |
| EP | 0356561 | A1 | 3/1990 |
| EP | 0449064 | A1 | 10/1991 |
| EP | 1584748 | A2 | 10/2005 |
| FR | 2471445 | A1 | 6/1981 |
| FR | 2597129 | A1 | 10/1987 |
| GB | 2250046 | A | 5/1992 |
| WO | 9002845 | A | 3/1990 |

OTHER PUBLICATIONS

International Search Report dated Oct. 25, 2007.

*Primary Examiner* — Abigail A Risic
(74) *Attorney, Agent, or Firm* — Perman & Green, LLP

(57) ABSTRACT

A temporary bridge includes bridge elements intended to be superimposed when the bridge is in a non-deployed position. The bridge elements are articulated one relative to another. Each bridge element includes, on at least at one of its ends, a coupling face configured to cooperate with the coupling face of another bridge element so as to assemble these bridge elements when they are placed in an end to end relation. The temporary bridge includes displacement members for each bridge element, superimposed on another bridge element in a first position, called a non deployed one, between this first position and a second position, called a deployed one, where the coupling faces of the bridge element and of the another bridge element are placed facing one another and coupled. Added or not rolling track can be included.

18 Claims, 3 Drawing Sheets

(56) References Cited

U.S. PATENT DOCUMENTS

| | | | | | |
|---|---|---|---|---|---|
| 4,302,022 | A | * | 11/1981 | Schoeffler et al. | 280/43.19 |
| 4,307,879 | A | * | 12/1981 | McMahon et al. | 472/85 |
| 4,571,144 | A | * | 2/1986 | Guidry et al. | 414/537 |
| 4,601,079 | A | | 7/1986 | Corica | |
| 4,635,311 | A | * | 1/1987 | Helmke | 14/2.5 |
| 4,806,065 | A | * | 2/1989 | Holt et al. | 414/481 |
| 5,042,101 | A | * | 8/1991 | Huether | 14/2.4 |
| 7,174,591 | B2 | * | 2/2007 | Bertrand et al. | 14/2.5 |
| 2006/0137113 | A1 | * | 6/2006 | Bertrand et al. | 14/2.5 |
| 2006/0137266 | A1 | * | 6/2006 | Whalen | 52/183 |

* cited by examiner

TEMPORARY BRIDGE

CROSS REFERENCE TO RELATED APPLICATIONS

This application is the National Stage of International Application No. PCT/EP2007/055349 International Filing Date, 31 May 2007, which designated the United States of America, and which International Application was published under PCT Article 21 (2) as WO Publication No. WO2007/138100 and which claims priority from French Application No. 0651976, filed on 31 May 2006, the disclosures of which are incorporated herein by reference in their entireties.

BACKGROUND

1. Field

The disclosed embodiments relate to a temporary bridge intended to the crossing of gaps, particularly for the passage of pedestrians, vehicles or other mobile equipment.

2. Brief Description of Related Developments

Such bridges enabling the crossing of a breach by means of one or more bridge elements assembled the ones with the others are known.

However, the transport and the deployment of these bridge elements require the use of a system for placing the bridge elements. The deployment system of these bridge elements is thus particularly complex to take into account both the significant dimensions of these bridge elements but also the useful surface area that presents the frame of the system for placing the bridge elements. Particularly, this system requires a launching frame enabling to deposit the assembled bridge elements forwards from the system.

Moreover, dimensions of the bridge elements require a released ground to allow their deployment.

A preparation of the ground by qualified operators can thus be necessary to be done before the bridge deployment, particularly, as an example, when wooded zones are adjacent to said breach to be crossed.

In addition, the rolling track of these bridge elements is likely to receive one or more heavy vehicles. This rolling track is thus rigid and integral with each bridge element. It can be, by way of example, carried out in steel, wood or composite material. This rolling track leads to increase the total weight of the bridge to be transported.

However, when the bridge elements are of dimensions higher than the launching frame, the weight of the bridge elements thus assembled must be compensated by the weight of the system for placing the bridge elements in order to avoid a possible imbalance of this one during the bridge taking down. The vehicle must have an adapted frame and is not very movable on rough ground.

Finally these prior art crossing systems are not autonomous and require the presence of service personnel which is then particularly exposed and vulnerable, for example, in conflict zones.

It would be thus interesting to have a compact and likely to be remotely deployed autonomous crossing structure.

SUMMARY

The aspect of the disclosed embodiments is thus to propose a system for surmounting gaps, which is simple in its design and its procedure, particularly compact and light to enable a deployment in difficult access zones and with any type of operational conditions.

Particularly, this temporary bridge can be stored and deployed from a reduced length tray or container which, once carried on the deployment area, is laid directly on the ground surface. This length of the bridge element as its width advantageously make it compatible with a tray or an ISO container of 20 feet enabling a road or even river transport of this one. In addition, the strong structure of a container authorizes a lifting by the top and protects the temporary bridge from the external aggressions.

Another aspect of the disclosed embodiments is to create a light temporary bridge enabling the implementation of less heavy installation equipment, therefore more mobile and likely to move in rough ground zones inaccessible with prior art systems for placing the bridge elements. This aspect is achieved with a light rolling track.

The rolling track of the temporary bridge can, for example, be added after the deployment of this one. The bridge deployment without its rolling track allows the implementation of a less complex and quickest deployment system.

To this end, the disclosed embodiments relate to a temporary bridge including bridge elements intended to be superimposed when said bridge is in a first position so-called a non-deployed position.

According to the disclosed embodiments, each bridge element comprises at least at one of its ends a coupling face ready to cooperate with the coupling face of another bridge element so as to assemble said bridge elements when they are placed end to end, these bridge elements are articulated the ones relative to the others by being connected one with the other by at least a pair of connection arms parallel and laterally assembled to said bridge elements, the arms ends being movable in rotation, the bridge comprises displacement members for each bridge element superimposed on another bridge element in said first position, between this first position and a second position, so-called a deployed one, where the coupling faces of this bridge element and of said another bridge element are placed facing one another and are coupled to form the bridge, and the temporary bridge comprises an added or not rolling track.

The temporary bridge comprises, in its non-deployed position, a stacking of bridge elements. These bridge elements are articulated one with the other via coupling arms. Two successive bridge elements of the stacking, i.e. two bridge elements intended to be placed end to end to form a part of the bridge are thus connected by at least a pair of coupling arms. The coupling arms of this pair are parallel and assembled laterally on said bridge elements.

The coupling arms of a same pair can be assembled on both sides of the bridge elements or alternatively on a same edge of these elements. These coupling arms can be connecting rods.

The deployment of the temporary bridge can take place in at least two ways. A first one consists in moving one after the other each bridge element of the stacking, starting from the higher end of the latter to place the bridge elements in an end to end relation in order to form the bridge.

Another consists, on the contrary, in moving in a stacking of n bridge elements, the last but one bridge element of this stack relative to the last bridge element of the stacking, i.e. that nearest to the ground, to place in an end to end relation these bridge elements by coupling them. The (n−2) other bridge elements which are placed above the last but one bridge element are, of course, moved with this one. Then, this operation is reiterated for the (n−2)th bridge element relative to the bridge elements assembly thus obtained and so on, until complete deployment of the temporary bridge.

Whatever be the method implemented to obtain the bridge deployment, the displacement of a bridge element relative to a bridge element immediately lower in the stacking involves due to the assembly of these bridge elements by at least a pair of coupling arms, a circular translation of said higher bridge element. To allow this displacement, the arms ends are assembled to be movable in rotation on the bridge elements.

The pair of coupling arms being placed on a same edge of the two successive bridge elements that it connects, these arms form with these bridge elements a regular parallelogram that may be deformed in a vertical plane during the displacement of the higher bridge element from the non-deployed position to its deployed position where it is placed in an end to end relation with the bridge element which was placed immediately below it in the stacking.

Here, it must be understood by "rolling track", the external surface of the temporary bridge on which the pedestrians, vehicles and other mobile equipment are intended to circulate. Of course, although not having track suitable for motor vehicles when the rolling track must be added, these elements are structurally ready to support these vehicles and/or pedestrians. Such bridge elements are then made up, on a purely illustrative basis, of a lattice structure or of a parallel beams assembly, these beams being spaced to each other in a regular or not way.

In various particular embodiments of this temporary bridge, each one having its particular advantages and being capable of many possible technical combinations:

said coupling faces are inclined faces, the slope of the coupling faces of a same bridge element being different so that said bridge elements being deployed and coupled form an arch.

each bridge element comprises at least a stop placed on at least one of its side edges to block the displacement of said coupling arm when the coupling face of said bridge element is placed facing one another with the coupling face of another bridge element, the bridge element intended to constitute the lower end of the stacking formed by said superimposed bridge elements comprises means for the anchoring on the ground, Of course, the bridge can still be unloaded from its freight vehicle by an equipment including lifting means. This lifting equipment can be a carriage with telescopic mast assembly, this mast assembly which can be controlled in direction and slope for example by means of a lifting jack connected to the telescopic arm. The equipment including the lifting means then provide the counterweight during the deployment of the temporary bridge.

This equipment is advantageously a cross-country vehicle. It can moreover be embarked at the frame rear of the temporary bridge freight vehicle. The bridge can thus be brought closer to its deployment place, for example by a truck, then the equipment including the lifting means brings said temporary bridge on its deployment area and provide the necessary counterweight during the deployment of this one.

The counterweight can also be provided by the freight vehicle having been used for the routing of the temporary bridge or by filling a liquid ballast tank by means of a pumping unit when the bridge is intended to allow the crossing of a breach including a water area.

Alternatively, the counterweight can also be provided by the bridge element forming the lower end of the stacking made of said superimposed bridge elements in the not deployed position of the temporary bridge, this bridge element having the weight necessary to act as a counterweight during the bridge deployment.

Instead of using a counterweight at the rear of the temporary bridge to ensure the bridge launching, i.e. the positioning of this one on a breach to be crossed, it is also possible to use a provisional structure placed at the temporary bridge front.

Thus, the bridge element located at the higher end of the stacking formed by the temporary bridge in its non deployed position can comprise a post-nozzle 21 comprising at its end an element for anchoring it on the ground.

This bridge element which is that intended to take support on the opposite side of the breach to be crossed, when the temporary bridge is posed on this one, comprises a housing 22 intended to receive the post-nozzle.

The post-nozzle 21 can be moved in translation partially out of this housing 22 to form a projection at the front of the temporary bridge.

The displacement of the post-nozzle 21 between a first rest position where the post-nozzle 21 is received in its housing 22 and a working position where it is partially out of its housing to form said projection at the front of the temporary bridge can be controlled manually or by hydraulic or pneumatic actuation.

The displacement of the post-nozzle 21 can thus be obtained by at least a hydraulic, pneumatic, electric actuating jack connected at one of its ends to the body of the bridge element and at its other end to the post-nozzle 21, this jack being placed inside the bridge element.

The post-nozzle 21 can also comprise a hollow section to receive the jack stem. The jack can also be a telescopic jack thus leading to small overall dimensions.

The displacement of the post-nozzle 21 can still be controlled by a rack system. On a purely illustrative basis, this system can comprise an electric or hydraulic motor rotating a toothed wheel assembled in the housing of the post-nozzle, this wheel being intended to cooperate with notches placed on the post-nozzle body, for example on the beam, to drive the latter in translation. Alternatively, it can still be a belt, chain, or cable driving system, this system then comprising pulleys and one or more motors.

However, these various mechanisms intended to provide the displacement of the post-nozzle 21 must be disengageable to allow a movement of free re-entry of the post-nozzle 21 in the case of the launching of a temporary bridge, or the movement of free exit of the post-nozzle 21 in the case of the recovery of the temporary bridge.

In the rack system above described, for example, the wheel intended to cooperate with the notches is a free wheel.

The post-nozzle is, for example, a rigid beam at the end of which is secured the ground anchoring element.

The ground anchoring element can comprise points radially arranged on surface of at least a half-cylinder. These points can moreover be rectilinear and/or slightly curved to provide to the post-nozzle a firm grasp on the ground.

In this particular embodiment, the post-nozzle is not necessarily totally received into its housing in its rest position. Only the beam can be inserted into the housing, the anchoring element projecting from the bridge element.

In addition, the bridge element receiving the post-nozzle can comprise guiding members making it possible to guide the translation displacement of the post-nozzle towards and out of its housing. Such a guiding element can, for example, be made of a pair of supports placed one facing the other while being spaced one to the other to allow the passage of the post-nozzle between both. These supports being placed at the entry of the post-nozzle housing, they can also ensure the efforts recovery when the post-nozzle is outgoing. These supports can be made of PTFE or in a self-lubricating material.

It is also possible to carry out the installation of these guiding members in such a way that the longitudinal axis of the post-nozzle is tilted relative to the longitudinal axis of the temporary bridge in its deployed position. This implementation mode allows to be easily ensured of the contact of the anchoring element with the ground.

For the launching of the temporary bridge, first of all, the vertical stacking of bridge elements is laid on a side of the breach to be crossed.

The bridge elements and the post-nozzle are then deployed so that the temporary bridge thus formed is partly placed over said breach while being connected to the opposite side of this breach only by the post-nozzle.

Then, the temporary bridge is raised so that the bridge is resting on the ground exclusively by the post-nozzle. For that, one can for example lift the temporary bridge on the side opposed to the post-nozzle with lifting means which can be placed on the freight vehicle having been used to convey the temporary bridge.

The bridge elements are then moved in translation in the direction of said opposite side of the breach to be crossed so as to return the post-nozzle into its housing, at least the end bridge element of the temporary bridge being then placed above the ground surface of the opposite breach side.

The ground anchoring element allows the post-nozzle to not slip on the ground of the opposite side, which could lead to a risk of blocking on an obstacle (stone, mud . . . ).

The displacement of the bridge elements can be obtained by moving the lifting means towards the breach side, for example by displacement of the freight vehicle.

Finally the temporary bridge is swiveled downwards so that it is resting on the two sides of the breach to be crossed.

This process for the installation of a temporary bridge is reversible, i.e. it can also be implemented to recover a temporary bridge launched over a breach.

In this case, the temporary bridge supported on the bank opposed by a bridge element, initially one makes sure that the ground anchoring element is projecting from the temporary bridge. The previously described process is used with however the difference that instead of returning the post-nozzle into its housing to bring the end bridge element over the opposed bank, the post-nozzle is taken out this housing to place the end bridge element above the void.

This installation/removal process of a temporary bridge, simple in its implementation, advantageously allows to not have to dismount the post-nozzle, once the bridge launching is carried out. Indeed, this one is inserted into its housing. This process does not require to have access to the opposite breach side to launch the bridge.

In addition, the installation or the removal of the temporary bridge is facilitated, the efforts having to be provided by the freight vehicle to move the temporary bridge being limited to the entry or the exit of the post-nozzle from its housing. The risks of skating of the vehicle are thus avoided and especially the freight vehicle does not have to be a heavy vehicle dedicated to this task.

said temporary bridge including an added rolling track, said track is a flexible rolling track and said bridge comprises fasteners to secure this flexible track to said bridge elements, Alternatively, said added rolling track can comprise metal plates articulated the ones relative to the others.

the rolling track comprises several track sections, each of these sections being integral with a bridge element, the rolling track is in one piece and removable, the flexible rolling track comprises at least a woven structure, This rolling track can also comprise an auxiliary woven structure comprising a layer of chain threads and a layer of weft threads, said woven structure being superimposed on said auxiliary woven structure and the connection between the two woven structures being realized in order to constitute between the two structures, from place to place, the tubular pockets directed according to chain threads or the weft threads.

Particularly, when these pockets are directed in the longitudinal direction of the bridge, they can act as a housing for the reception of elements added to various purposes. Particularly, it is possible to pass one or more cables for the electric power supply of the means providing the relative displacement of the bridge elements. It is still possible to pass the communication or supply cables for the lighting of the temporary bridge.

These pockets can also receive metallic or of composite material reinforcement rods. When, these pockets are equipped with transverse reinforcement rods, the ends of these bars can form projections intended to cooperate with guiding rail elements laid out on the bridge elements. The ends of these bars can thus slide into rails having a C- or U-shaped section, which not only allows to ensure the guidance of the rolling track along said bridge element but allows also its securing on this one.

In a more general way, the rolling track can comprise a higher face having the surface relief necessary to a good adherence of the vehicles circulating on its surface, such as the woven structure described by the present applicant in the patent application WO 95/26435 and a plane lower face ensuring the slipping of the rolling track on the bridge elements. This lower face can be made of said auxiliary woven structure.

This lower face can also comprise fasteners necessary to secure said rolling track to the bridge elements. In a particular embodiment, this lower face can comprise eyelets intended to receive projections placed on the surface of the bridge elements. These projections can be pins including at their higher end a stop, the pins being then forcedly inserted into the eyelets.

These eyelets are, preferably, placed just above the pockets formed by the connection of the auxiliary structure and the woven structure to form housings likely to receive said projections.

each bridge element comprises, on at least one of its side edges, a guiding rail element, these rail elements cooperating ones with the others to define a guiding rail when the bridge elements are placed in an end to end relation allowing to guide the displacement of said track along said bridge, the displacement members comprise at least an actuator assembled in a swiveling way, the end of this actuator being connected to one of the coupling arms so as to move a bridge element relative to another between a first position called a non deployed one, where said bridge elements are superimposed and a second position called a deployed one where the coupling faces of said bridge elements are placed one facing the other for their coupling, this actuator is a hydraulic, electromagnetic or electric actuating jack, The rotation driving of the coupling arms can still be provided by motors or a crank via a screw and nut or endless screw system.

the actuator being an electric jack, the bridge comprises an autonomous power supply to supply these electric actuators, at least one of said bridge elements comprises at least a projection, said projection being placed ahead from said bridge element below its coupling face and being intended to support the bridge element placed in an end to end relation with said bridge element, it comprises a checking and control unit to individually control the displacement of the bridge elements, said control unit including a transmitter-receiver to receive remote control commands, these bridge elements are case-bays.

These bridge elements can be with a fixed width or to have an adjustable width. Indeed, it can be interesting to maintain reduced dimensions to these bridge elements for their storage and their transport, while having a significant rolling track width. For that, each bridge element can comprise a beam assembly comprising a fixed central beam connected to lateral beams by a spacing adjustment system between the central beam and these lateral beams. On a purely illustrative basis, this adjustment system can comprise jacks connected at their ends to said beams and placed between those. These jacks are, for example, hydraulic actuating jacks.

Of course, when the rolling track is made of several track sections which are each one integral of a bridge element, each of these track sections comprises at least two parts at least partially superimposed and likely to slip one relative to the other to adapt to the width variations of the bridge element.

Each one of these parts is, for example, made integral of a side beam. The displacement of this side beam relative to the central beam involves a corresponding slip of the part of track section.

The disclosed embodiments also relate to a temporary bridge with several rolling track. According to the disclosed embodiments, this bridge comprises at least two temporary bridges as described previously, these bridges being preferably placed in parallel and joined the one to the other.

Advantageously, one of the temporary bridges can act as a counterweight during the deployment of the first bridge and this last being deployed, the deployment of another bridge can be carried out by taking support on this first bridge, requiring thus no external counterweight.

Finally, the disclosed embodiments relate to an installation equipment provided with a temporary bridge as previously described.

This installation equipment comprises, preferably, a tray intended to receive the superimposed bridge elements when this one is in a not deployed position as well as a storage area for the rolling track.

The latter appearing as a woven structure having a significant surface relief and rolled up, the storage area can comprise an unrolling device to ensure the unrolling at a variable speed of said woven structure.

BRIEF DESCRIPTION OF THE DRAWINGS

The disclosed embodiments will be described more in detail with reference to the annexed drawings in which.

DETAILED DESCRIPTION OF THE DISCLOSED EMBODIMENTS

Figure 1:
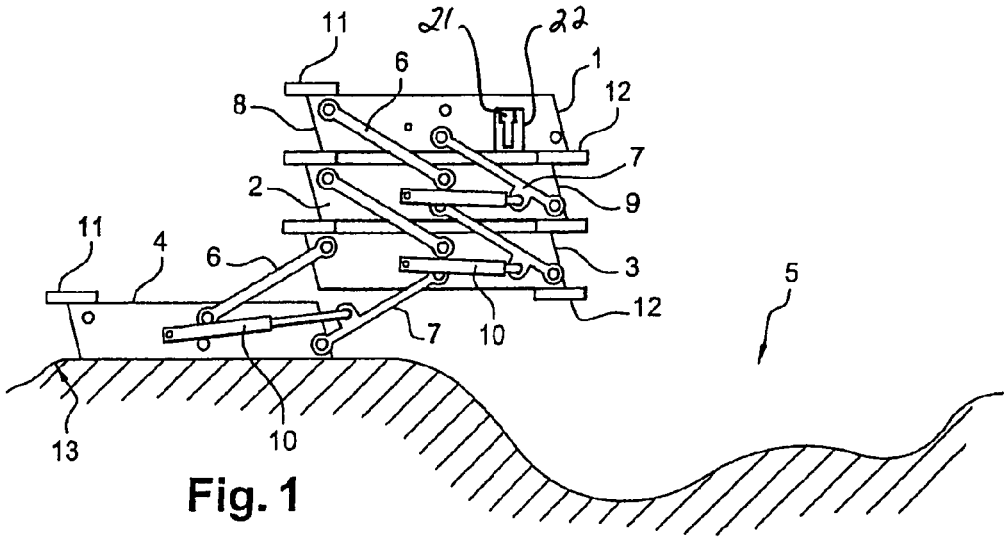
FIG. 1 schematically represents a temporary bridge during the deployment according to a particular embodiment.
Figure 2:
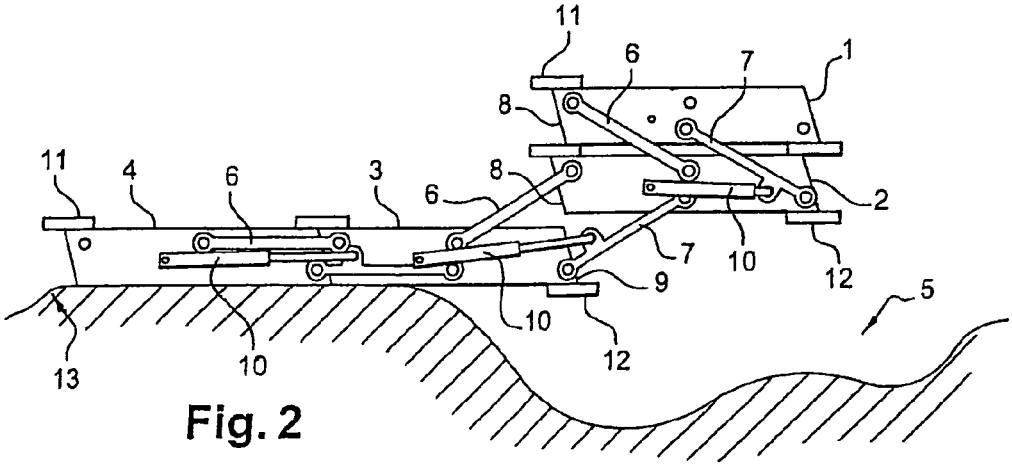
FIG. 2 is a diagrammatic representation of the temporary bridge of FIG. 1 after deployment of a part thereof.
Figure 3:
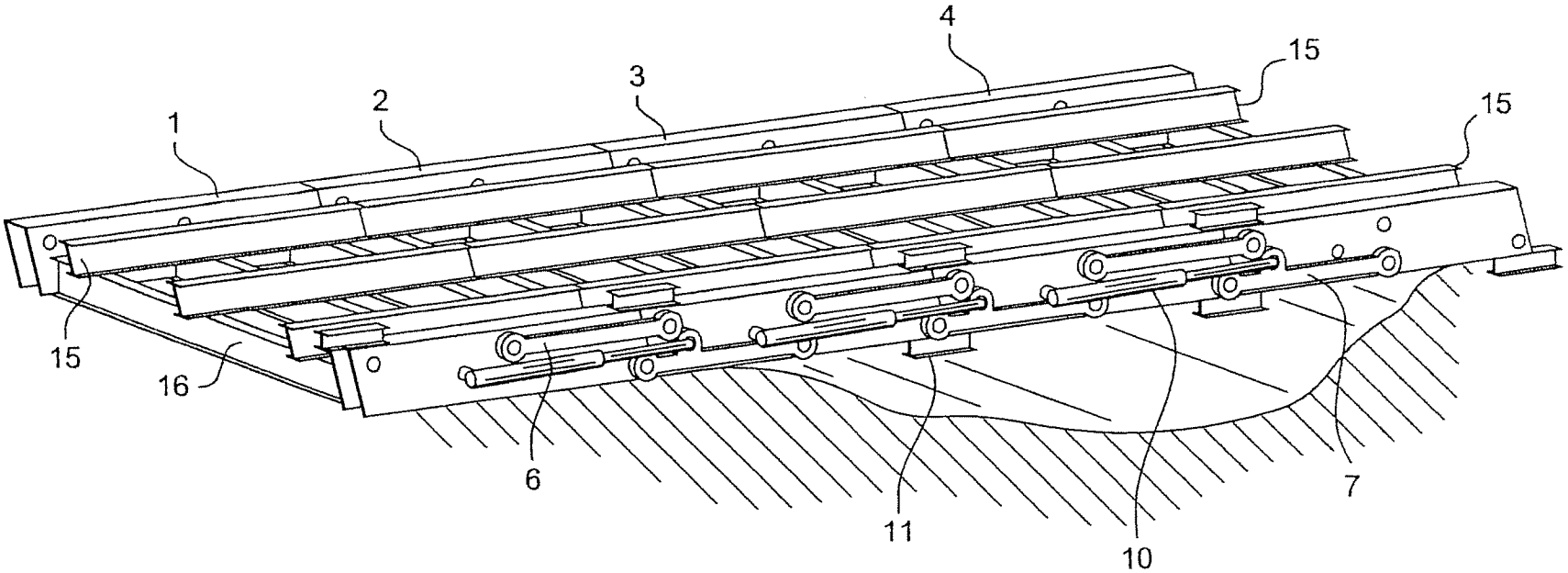
FIG. 3 is a diagrammatic representation of the temporary bridge of FIG. 1 deployed, the added rolling track having been omitted for clarity.

FIG. 1 shows a temporary bridge in a not deployed position according to a first embodiment. It comprises four bridge elements 1-4 which are superimposed, thus forming a vertical stacking, and articulated the ones relative to the others.

These bridge elements 1-4 are advantageously connected, in a removable way, the ones to the others to make it possible to vary the length of this bridge and to adapt this one to the breach 5 to be crossed.

Each bridge element is connected to only one 1, 4, for those intended to form the ends of the bridge, or two other bridge elements 2, 3 by two pairs of coupling arms assembled each one on both sides of these bridge elements 1-4 which they connect (only one being represented for clarity). Each one of these arms pairs comprise two parallel arms 6, 7 assembled laterally on these bridge elements 1-4, their ends being movable in rotation to allow the relative displacement of the bridge elements 1-4.

These arms present the shape of a parallelogram that may be deformed when a bridge element is moving relative to the bridge element with which it is articulated.

Each bridge element 1-4 thus comprises at its ends a coupling face 8 ready to cooperate with the coupling face 9 of another bridge element so as to assemble these bridge elements when they are placed in an end to end relation.

These coupling faces 8, 9 have a beveled profile but can have any other form allowing to block the coupling faces 8, 9 when they are placed in an end to end relation.

These faces 8, 9 present here, in addition, a slope of value equal from a pair of bridge elements to another but these slopes can also be different so as to form a curvature between two bridge elements 1-4.

This curvature particularly can be progressive to form an arch. This last geometry provides a better mechanical strength of the temporary bridge by an effort recovery and it can enable spanning obstacles such as a pipe or other.

Each bridge element 1-4 can moreover comprise locking mechanical members making it possible to block the coupling faces 8, 9 in a coupled position. These locking members comprise, for example, spring.

In addition, each bridge element 1-4 advantageously comprises at least a stop placed on each one of its side edges to block the displacement of at least one of the coupling arms 6, 7 when the coupling face 8 of said bridge element 3 is placed facing to the coupling face 9 of another bridge element 4 and that it thus finished its allowed displacement (FIG. 1).

The bridge comprises displacement members of each bridge element 1-3 which is superimposed on another bridge element 2-4 in a first position, called a non deployed one.

To deploy the temporary bridge, first of all the stacking formed by the three bridge elements 1-3 placed on the last bridge element 4 is moved in contact with the ground. These bridge elements 1-3 are moved from a first position in which they are superimposed on the fourth bridge element 4 towards a second position, called deployed, where the coupling faces 8, 9 of the last bridge element 3 of said stacking 1-3 and of the fourth bridge element 4 are placed in facing relation and are coupled. Then, this deployment step is repeated by moving the two bridge elements 1, 2 superimposed with the third bridge element 3 thus coupled from this first position where they are superimposed towards a second position where the coupling faces 8, 9 of the second bridge element 2 and of the third bridge element 3 are placed in facing relation and are coupled. This step is repeated for the first bridge element 1 not yet coupled. This process enables to decrease the lever ratio to be moved.

The displacement members comprise an actuator 10 assembled in a swiveling way and laterally on each bridge element 2-4 intended to support a bridge element 1-3 in the first position called a non deployed one.

The end of this actuator 10 is connected to the coupling arms the more ahead of said bridge element 1-4 so that a linear displacement of the end of this actuator 10 involves a rotational movement of the bridge element(s) superimposed to bring the coupling faces 8, 9 in facing relation.

This actuator 10 is, for example, a hydraulic, electromagnetic or electric actuating jack. This actuator 10 being a hydraulic actuating jack, the bridge comprises a fluid tank, a hydraulic pump and a fluid distribution circuit including piping sections ready to adapt to the movement of the bridge elements 1-4 the ones relative to the others. Each one of these sections can, for example, comprise two portions of rigid pipes connected one with the other by a flexible tube section placed at the level of an articulation such as a pivot point of a connecting rod.

Preferably, the bridge comprises a checking and control unit to individually control the displacement of the bridge elements 1-4, this control unit including a transmitter-receiver to receive remote control commands.

The bridge having thus its own supply source and being autonomous, can advantageously be positioned near the breach 5 to be crossed in order to be deployed remotely which avoids exposing a possible crew of the engineers corps in conflict zones.

This checking and control unit can still comprise electronic means to delay the displacement of each one of said elements so that said bridge elements are deployed and successively placed in an end to end relation. These electronic means can comprise a delaying device. Alternatively, these bridge elements can be deployed simultaneously.

The checking and control unit can still comprise sensors for checking the good positioning of the bridge elements 1-4 the ones relative to the others.

In this particular embodiment, the bridge elements 1-4 comprise each one two projections 11,12 respectively placed ahead of said bridge element below its coupling face 8 and behind, below its other coupling face 9. These projections 11, 12 are intended to support the bridge element(s) 1-4 placed in an end to end relation with this bridge element 1-4. These projections 11, 12 for example consist in a rectangular plate.

The bridge element 4 intended to constitute the lower end of the stacking formed by said bridge elements 1-4 superimposed in said first position comprises advantageously ground anchoring means (not represented).

The temporary bridge comprises an added rolling track 17 which is a flexible rolling track and fasteners 18 to secure this flexible rolling track to the bridge elements 1-4.

This rolling track advantageously presents a longitudinal dimension (L) higher than the length of the bridge once deployed so as to cover a ground zone 13, 14 adjacent to said bridge.

This rolling track is, for example, a woven structure which is made of chain threads laid out according to only one layer of warp threads 19 and of weft threads 20 also laid out according to only one layer, the weave 25 of said woven structure being such as each warp thread 19 intersects the weft threads 20 along, preferably and very roughly, the half of the intersections of the rows and columns of the weave 25, the warp thread 19 being left in the remaining intersections, in order, for each warp thread 19, to obtain at least a simple and tightened weave 25 area followed by a loose thread zone, the alternation of the various said zones causing tightenings of the weft threads 20 creating a significant relief of the weave 25 of the woven structure.

One understands by "preferably and very approximately", an equality of the takings and the leavings of each warp thread which is not absolute but which on the contrary can deviate, for example, from 10 to 15% to it, and even more, being understood that the more one will move away from the strict equality and the more the weaving loom will need adjustments.

The weft threads have advantageously a diameter of about 50 to 200 hundredths of mm and the warp threads have preferably a diameter lower than that of the weft threads.

The bridge elements 1-4 comprise beams 15 assembled in parallel while being spaced from each other. These beams 15 are carried out into a hard material selected in the group comprising the steel, the titanium, an aluminum alloy or a composite material. These beams 15 can have a rectangular or a I-shaped section with a plane surface at each end to support the rolling track. These beams 15 can moreover be connected by a bottom 16 which can be bored for the drainage.

Figure 4:
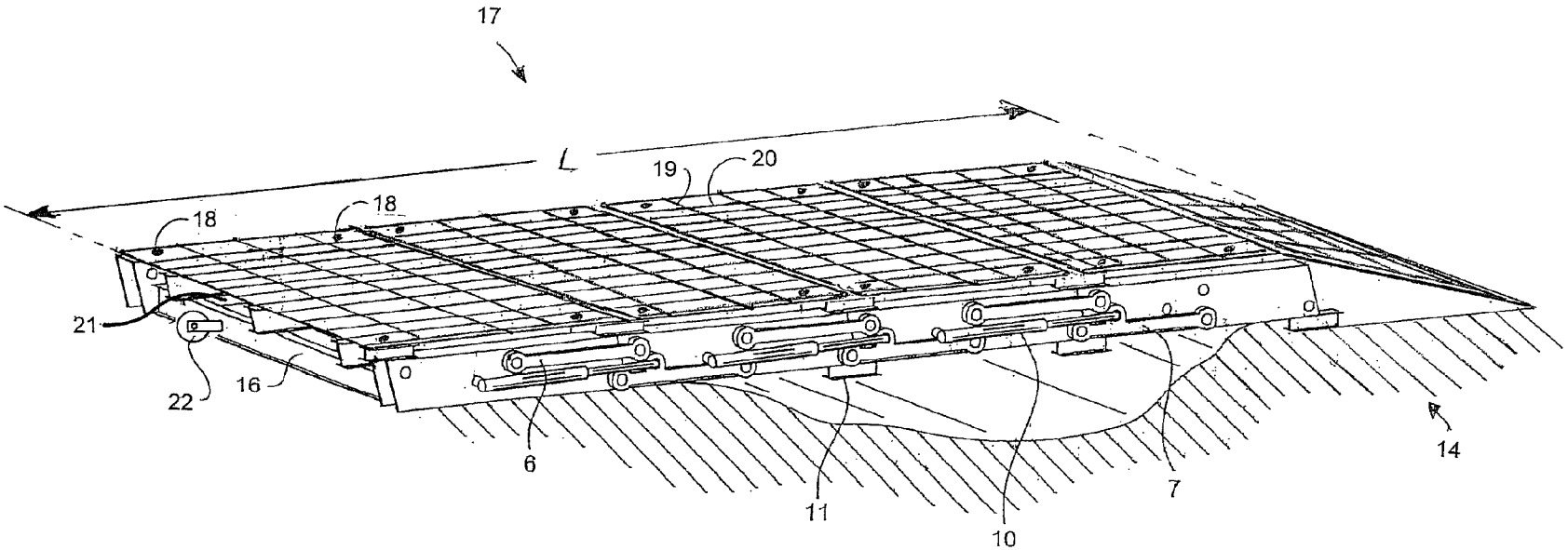
FIG. 4 is a diagrammatic diagram of the temporary bridge showing the added rolling track.

The interval between these beams 15 defines a conduit 21 (FIG. 4) likely to receive a traction element 26 of the rolling track when this one is unrolled after deployment or progressively during the bridge deployment. The bridge can thus comprise a motor to unroll or roll up this track. Each bridge element 1-4 comprises at one end, at least a return member 22 (FIG. 4) likely to receive said traction element 26. This return member 22 can be a pulley.

The first and the last of these bridge elements 1, 4 making the bridge in deployed position advantageously comprise at their free end an access ramp to said bridge. This ramp can be assembled in an articulated way to adapt the ramp to equipments or pedestrians brought to move on the temporary bridge surface.

The bridge elements 1-4 being identical or not, they have a longitudinal dimension ranging between approximately 2 m and 6 m+/−10% and a width ranging between approximately 1.5 and 3 m+/−10%. Advantageously, their length being of 6 m and their width approximately of 2 m, a rolling track having a width of 3.4 m+/−10% is obtained by joining two temporary bridges arranged in parallel.

The invention claimed is:

1. A temporary bridge comprising:

a plurality of bridge elements configured to be superimposed on each other in a stack when said temporary bridge is in a first non-deployed position, each bridge element comprising:

a top side, a bottom side, two side edges and two end faces;

an inclined coupling face on at least one end face, the inclined coupling face configured to cooperate with an inclined coupling face of another bridge element so as to assemble said bridge elements when they are placed end to end, and at least a pair of connection arms, parallel and laterally assembled to said bridge element, and articulating each bridge element relative to another bridge element, the arms ends being movable in rotation, wherein the displacement of a bridge element above an immediately lower bridge element in the stack comprises a circular translation of said above bridge element with respect to the immediately lower bridge element in the stack, and the temporary bridge comprises displacement members coupled to each bridge element for moving the bridge elements from a first non-deployed, stacked position to a second, deployed position, where the inclined coupling faces of the bridge elements are placed facing one another and are coupled to form the temporary bridge.

2. The temporary bridge according to claim 1, wherein said bridge elements are detachably connected to allow the length of the bridge to be varied.

3. The temporary bridge according to the claim 1, wherein a lowermost bridge element of the superimposed bridge elements comprises means for anchoring the lowermost bridge element to a ground surface.

4. The temporary bridge according to claim 1, wherein said connection arms are assembled on both sides of said bridge elements.

5. The temporary bridge according to claim 1, wherein each bridge element comprises a stop placed on at least one side edge to block the displacement of said connection arm when the inclined coupling faces of said bridge elements are placed facing one another.

6. The temporary bridge according to claim 1, wherein the slope of the two inclined coupling faces of a single bridge element being different so that said bridge elements being deployed and coupled form an arch.

7. The temporary bridge according to claim 1, wherein said temporary bridge includes a flexible rolling track and said temporary bridge comprises fasteners to secure the flexible rolling track to said bridge elements.

8. The temporary bridge according to claim 7, wherein said flexible rolling track comprises several track sections, each section being integral with a bridge element.

9. The temporary bridge according to claim 8, wherein said flexible rolling track presents a longitudinal dimension greater than a length of the temporary bridge once deployed so as to cover a ground zone adjacent to said temporary bridge.

10. The temporary bridge according to claim 7, wherein said flexible rolling track comprises at least a woven structure.

11. The temporary bridge according to claim 10, wherein said woven structure is formed of warp threads disposed along a single layer and of weft threads also disposed along a single layer, a weave of said woven structure wherein the warp threads are interlaced with the weft threads approximately along half of an intersection of rows and columns of the weave, the warp threads having at least one tight single weave zone followed by at least one loose thread zone, the alternation of said one tight single weave zone and said one loose thread zones providing retightenings of the weft threads creating a large relief of the weave.

12. The temporary bridge according to claim 7, wherein each bridge element comprises, on at least one side edge, a guiding rail element, wherein guiding rail elements of each bridge element cooperate to define a guiding rail when the bridge elements are placed in an end to end relation.

13. The temporary bridge according to claim 12, wherein each bridge element comprises beams assembled in parallel and spaced from each other, an interval between said beams defining a conduit configured to receive a traction element of the added rolling track wherein each bridge element comprises at one end, a return member configured to receive said traction element.

14. The temporary bridge according to claim 1, wherein said displacement members comprise an actuator configured to swivel, an end of said actuator being connected to one of said connection arms so as to move one bridge element relative to another between the first, non-deployed position, stacked position and the second, deployed position where the inclined coupling faces of said bridge elements are placed one another and said temporary bridge comprises a checking and control unit to individually control the displacement of said bridge elements, said control unit including a transmitter-receiver to receive remote control commands.

15. The temporary bridge according to claim 14, wherein said control unit comprises electronic means to delay the displacement of each one of said bridge elements so that said bridge elements are deployed and successively placed in an end to end relation.

16. The temporary bridge according to claim 1, wherein at least one of said bridge elements comprises a projection, said projection being placed ahead of said bridge element below its coupling face and supporting the bridge elements when they are placed end to end.

17. The temporary bridge according to claim 1, wherein said temporary bridge comprises a post-nozzle having at its end an element for anchoring it on the ground, said post-nozzle being mounted on the bridge element located at the top of the stack formed by the temporary bridge in its non-deployed position, said bridge element comprising a housing to receive said post-nozzle, said post-nozzle being adapted to move between a first rest position where said post-nozzle is received in its housing and a working position where it is partially out of its housing to form a projection at the front of the temporary bridge.

18. The temporary bridge according to claim 1, further comprising several rolling tracks and at least two other temporary bridges, the temporary bridges being placed in parallel and joined one to the other.

* * * * *